US005981063A

United States Patent [19]

Yokozeki et al.

[11] Patent Number: 5,981,063

[45] **Date of Patent: *Nov. 9, 1999**

[54] FIBER PRODUCT CONTAINING PYROELECTRIC SUBSTANCE

[75] Inventors: Masao Yokozeki, Tokyo; Izumi Yuasa, Kurashiki; Kenji Hiramatsu, Otsu, all of Japan

[73] Assignees: Kuraray Co., Ltd.; Nihon Epoque Co., Ltd., both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/622,142

[22] Filed: Mar. 27, 1996

[30] Foreign Application Priority Data

Mar. 27, 1995 [JP] Japan ..... 7-091997

[51] Int. Cl.[6] ..... D02G 3/02

[52] U.S. Cl. ..... 428/365; 428/372; 442/187; 442/228; 442/301; 442/330; 442/376; 442/322; 442/380; 442/414; 442/417

[58] Field of Search ..... 428/240, 242, 428/245, 263, 288, 289, 365, 372; 442/228, 187, 301, 330, 322, 414, 417, 376, 380

[56] References Cited

U.S. PATENT DOCUMENTS 5,531,869 7/1996 Kubo ..... 502/202

FOREIGN PATENT DOCUMENTS

| | | |
|---|---|---|
| 0116865 | 8/1984 | European Pat. Off. . |
| 2169764 | 6/1990 | Japan . |
| 3076867 | 4/1991 | Japan . |
| 4327207 | 11/1992 | Japan . |
| 5140837 | 6/1993 | Japan . |
| 6173162 | 6/1994 | Japan . |
| 6184808 | 7/1994 | Japan . |
| 6228808 | 8/1994 | Japan . |
| 7178026 | 7/1995 | Japan . |

*Primary Examiner*—Elizabeth M. Cole

*Attorney, Agent, or Firm*—Wenderoth, Lind & Ponack, L.L.P.

[57] ABSTRACT

The present invention provides a fiber product containing a pyroelectric substance and metal ion-holding inorganic particles. With this fiber product wherein the pyroelectric property of the pyroelectric substance is amplified by the metal ion-holding inorganic particles, there can be sufficiently obtained, with no necessity of using a large amount of a pyroelectric substance which is expensive, various effects, for example, activities of ameliorating diseases and promoting health (e.g. acceleration of blood circulation, cure of autonomic imbalance and promotion of metabolism), activity of maintaining the freshness of foods or natural flowers, activity of removing oil or other stains, and microbicidal activity.

10 Claims, No Drawings

FIBER PRODUCT CONTAINING PYROELECTRIC SUBSTANCE

The present invention relates to a fiber product containing a pyroelectric substance and metal ion-holding inorganic particles. More particularly, the present invention relates to a fiber product which is excellent not only in the activities of ameliorating diseases and promoting health (e.g. acceleration of blood circulation, the cure of autonomic imbalance and promotion of metabolism) but also in the activity of maintaining the freshness of foods or natural flowers, as well as for removing oil or other stains, and also for its microbicidal activity. Owing to these excellent properties, the fiber product of the present invention can be very effectively used for clothes, other wears, bedding, wrapping materials for foods or natural flowers, wiping goods (e.g. wiping cloths), etc.

It is widely known that tourmaline has a pyroelectric property. It is also widely known that owing to this unique pyroelectric property, pyroelectric minerals such as tourmaline and the like stimulate the pressure points of human body thereby exhibiting activities of ameliorating diseases and promoting health (e.g. acceleration of blood circulation, promotion of metabolism and cure of autonomic imbalance). In order to obtain such effects, there have been made various attempts of allowing textile goods such as clothes and bedding (these are used in contact with the human body) to contain a pyroelectric mineral (e.g. tourmaline) [Japanese Patent Application Kokai (Laid-Open) Nos. 169764/1990, 184808/1994 and 228808/1994, Japanese Utility Model Application Kokai (Laid-Open) No. 2579/1993, etc.].

Pyroelectric minerals such as tourmaline and the like, however, are very expensive. In particular, pyroelectric minerals which are finely powderized to be made easily into fibers, are more expensive. Therefore, to allow a pyroelectric mineral to be contained in a fiber or a fiber product at a high concentration is virtually difficult for economical reasons, etc. Consequently, neither fibers nor fiber products which contain pyroelectric minerals and which have high practical utilities, are commercially available at the present time, although such pyroelectric minerals have excellent and unique properties as mentioned above.

Under the above circumstances, the present inventors have made an extensive study out to find out a method capable of sufficiently utilizing the excellent properties of pyroelectric minerals or amplifying the properties without using a pyroelectric mineral (which is expensive) in a large amount. As a result, the present inventors found out that when a pyroelectric substance (e.g. a pyroelectric mineral) is used in combination with a particular metal ion, the above-mentioned unique properties of the pyroelectric mineral are amplified; the amount of pyroelectric substance used can be reduced; and the pyroelectric substance, even when used in a reduced amount, can show, by stimulation of pressure points, sufficiently high effects in acceleration the blood circulation, promotion of metabolism, cure of autonomic imbalance, etc. and is very effective for amelioration of diseases and promotion of health.

The present inventors also found out that a fiber product (e.g. a cloth) containing a pyroelectric substance and a particular metal ion in combination has an activity of maintaining the freshness of foods or natural flowers and is very effective as a wrapping material for foods or natural flowers, and is also very effective as a wiping goods used for washing of oil-stained tableware or other articles.

Based on the above findings, the present inventors have made further studies to find an improved method for allowing a fiber or a fiber product to contain a pyroelectric substance and a metal ion in combination. As a result, the present inventors have discovered that when a metal ion is held by particles of an inorganic substance (e.g. a ceramic) and, in that state, is allowed to be contained in a fiber or a fiber product or is deposited thereon, the above-mentioned activities of the pyroelectric substance, that is, the activities of ameliorating diseases and promoting health (e.g. acceleration of blood circulation, cure of autonomic imbalance and promotion of metabolism), the activity of maintaining the freshness of foods or natural flowers, the activity of removing stains are sufficiently amplified and moreover these activities are neither reduced nor lost in a short period of time and are effective for a long time.

According to the present invention, there is produced a fiber product containing a pyroelectric substance and metal ion-holding inorganic particles, more particularly, a fiber product wherein the constituent fiber contains a pyroelectric substance and metal ion-holding inorganic particles, or has such pyroelectric substance and the particles both deposited thereon.

The present invention is hereinafter described in detail.

As mentioned above, the fiber product of the present invention must contain a pyroelectric substance and metal ion-holding inorganic particles in combination. The pyroelectric substance and the metal ion-holding inorganic particles may be contained in the fiber constituting the fiber product, or may be deposited on the fiber in a state that they do not detach from the fiber.

In the present invention, the "pyroelectric substance" may be any substance capable of exhibiting pyroelectricity. Typical examples of the pyroelectric substance usable in the present invention include pyroelectric minerals such as tourmaline, hemimorphite and the like. Of these, tourmaline is preferably used. These pyroelectric substances are preferably used in the form of fine particles or a fine powder because this form has a large surface area, exhibits a pyroelectric property and increases the above-mentioned effects. Use of the pyroelectric substance in the form of a fine powder or fine particles is also preferable from the standpoints of uniform dispersion the pyroelectric substance in the fiber, to prevent end breakage of the pyroelectric substance-containing fiber during spinning to increases the adhesion strength or resistance to detachment when a pyroelectric substance is deposited on a fiber, and to enhance the strength of the obtained fiber, etc. Therefore, the pyroelectric substance desirably has an average particle diameter of generally 2 $\mu$m or less, preferably 1 $\mu$m or less.

In the metal ion-holding inorganic particles, the metal ion held by inorganic particles includes the ions of at least one metal selected from silver, zinc, copper, gold, platinum, iron, nickel, cobalt, lead, chromium and tin. The ions of these metals may be held by inorganic particles, singly or in combination of two or more ions. When the fiber product of the present invention is a product used in contact with the human body, such as clothing, other wear, bedding or the like, or a product used for foods, tableware or the like, such as a wrapping material for foods, a wiping cloth for tableware, or the like, it is preferable that an ion of at least one metal selected from silver, zinc, copper, gold, platinum, iron, nickel and cobalt be used so as to be held by the inorganic particles for reasons of safety and sanitation.

The inorganic particles used for holding the metal ion may be any inorganic particles as long as they do not cause deterioration of the fiber, etc. However, inorganic particles having ion exchangeability or metal ion adsorptivity and having high metal ion-holding abilities are used preferably.

Typical examples of preferred inorganic particles are those having ion exchangeability, such as zeolite, zirconium phosphate, calcium phosphate and the like. Of these, zeolite is most preferred. Use of zeolite which is sufficiently heat-dried and which is low in water content, is preferable because there are little problems when the metal ion-holding zeolite is added to a fiber-forming polymer and the resulting mixture is spun and further because the resulting fiber shows no reduction in strength.

The inorganic particles used for holding the metal ions, preferably have an average particle diameter of 3 μm or less, particularly 2 μm or less, more particularly 1 μm or less. When the average particle diameter of the inorganic particles is larger than 3 μm, there tend to occur filter plugging and end breakage during spinning, and the spinning operation tends to be affected. When the average particle diameter of the inorganic particles is too small (e.g. 0.1 μm or less), the particles tend to cause secondary adhesion, which easily invites filter plugging during spinning and fluffing during fiber stretching.

The metal ion-holding inorganic particles are preferably those inorganic particles which hold metal ions at high concentrations. When the inorganic particles are, for example, zeolite having ion exchangeability, it is preferable that at least 90% of the ion exchange capacity of the zeolite is ion-exchanged with a metal ion. When the inorganic particles hold a metal ion by their physical adsorptivity, it is preferable that the metal ion is adsorbed by the inorganic particles in an amount corresponding to at least 90% of saturated adsorption.

The metal ion-holding inorganic particles are obtained generally by subjecting inorganic particles to an impregnation treatment with, for example, an aqueous solution of an ion of at least one metal selected from the above-mentioned metals (e.g. silver and zinc) and then drying the resulting inorganic particles. Needless to say, there can be employed any other method capable of preparing inorganic particles holding a metal ion at a high concentration.

In the present invention, as mentioned previously, the pyroelectric substance and the metal ion-holding inorganic particles may be allowed to be contained in a fiber, or may be deposited on a fiber by using a binder (e.g. an adhesive resin) so that they do not detach. When the material fiber to be used for preparation of the present fiber product is a natural fiber such as cotton, hemp, wool, silk or the like, it is difficult to allow the fiber to contain a pyroelectric substance and/or metal ion-holding inorganic particles; therefore, in this case, it is preferable that the pyroelectric substance and/or the metal ion-holding inorganic particles are deposited on the fiber with a binder. When the material fiber is a synthetic fiber, a semisynthetic fiber or a regenerated fiber, a fiber containing a pyroelectric substance and/or metal ion-holding inorganic particles can be produced by adding a pyroelectric substance and/or metal ion-holding inorganic particles to a spinning material containing a fiber-forming polymer and then spinning the mixture; alternatively, a pyroelectric substance and/or metal ion-holding inorganic particles may be deposited, by the use of a binder, on a synthetic fiber, a semisynthetic fiber or a regenerated fiber each produced by spinning.

In the synthetic fiber, the semisynthetic fiber or the regenerated fiber each containing a pyroelectric substance and/or metal ion-holding inorganic particles, produced by adding a pyroelectric substance and/or metal ion-holding inorganic particles to a spinning material containing a fiber-forming polymer and then spinning the mixture, the pyroelectric substance and the metal ion-holding inorganic particles are strongly held in the fiber and do not easily detach; therefore, such a fiber can exhibit the above-mentioned activities such as acceleration of blood circulation and the like stably for a long time.

In producing a fiber containing a pyroelectric substance and/or metal ion-holding inorganic particles, by adding a pyroelectric substance and/or metal ion-holding inorganic particles to a spinning material containing a fiber-forming polymer and then spinning the mixture, the pyroelectric substance and/or metal ion-holding inorganic particles can be allowed to be present in the fiber in various modes as follows.

(I) The pyroelectric substance and/or metal ion-holding inorganic particles are allowed to be present in a fiber uniformly.

(II) The pyroelectric substance and/or metal ion-holding inorganic particles are allowed to be present in a fiber in different concentrations (distribution) at the center of fiber section and at the periphery of fiber section. In the case of, for example, a core-sheath conjugated fiber, the pyroelectric substance and/or metal ion-holding inorganic particles are allowed to be present only in the core or the sheath, or are allowed to be present so that their concentrations in core and sheath are different.

(III) The pyroelectric substance and/or metal ion-holding inorganic particles are allowed to be present in a fiber in a sea-island form. For example, the pyroelectric substance and/or metal ion-holding inorganic particles are allowed to be present only in the sea or islands of a sea-island type conjugated fiber, or are allowed to be present in both the sea and islands so that their concentrations in sea and islands are different.

(IV) The pyroelectric substance and/or metal ion-holding inorganic particles are allowed to be present in a fiber in a side-by-side form. For example, the pyroelectric substance and/or metal ion-holding inorganic particles are allowed to be present only in one side of a side-by-side type conjugated fiber, or are allowed to be present in both sides so that their concentrations in two sides are different.

(V) The pyroelectric substance and/or metal ion-holding inorganic particles are allowed to be present in a fiber randomly.

In producing the fiber product of the present invention containing both a pyroelectric substance and metal ion-holding inorganic particles, the following production methods can be employed, for example.

(1) A method which comprises preparing a fiber (A) containing a pyroelectric substance or having the substance deposited thereon and a fiber (B) containing metal ion-holding inorganic particles or having the particles deposited thereon and using the fiber (A), the fiber (B) and, as necessary, other fiber (C) to produce a yarn, a cloth or other fiber product.

(2) A method which comprises preparing a fiber (D) containing a pyroelectric substance and metal ion-holding inorganic particles or having the substance and the particles both deposited thereon and using the fiber (D) and, as necessary and other fiber (C) to produce a fiber product.

There can also be employed any other method as long as it can produce a fiber product containing a pyroelectric substance and metal ion-holding inorganic particles in all the portions.

In producing the fiber product of the present invention, use of the method (1) is preferable for the following reasons. In the method (1), since the fiber (A) contains only a pyroelectric substance and the fiber (B) contains only metal ion-holding inorganic particles, the content of pyroelectric substance or metal ion-holding inorganic particles in the spinning material can be made low; as a result, there is little problem during spinning (e.g. plugging in spinning solution pack or end breakage during spinning) and the fibers (A) and (B) can each have a sufficiently high strength. Moreover, when the fiber (A) containing a pyroelectric substance or having the substance deposited thereon, in a given amount, the fiber (B) containing metal ion-holding inorganic particles or having the particles deposited thereon, in a given amount and the fiber (C) used as necessary are independently prepared in advance, it is possible to vary the proportions of the fiber (A), the fiber (B) and the fiber (C) used, depending upon the type and application of the fiber product to be produced and thereby easily produce a fiber product containing a pyroelectric substance and metal ion-holding inorganic particles at desired concentrations.

The method (1) for producing a cloth or other fiber product each containing a pyroelectric substance and metal ion-holding inorganic particles includes the following, for example.

(1-1) A method which comprises producing a blended yarn containing a pyroelectric substance and metal ion-holding inorganic particles from a short fiber (A), a short fiber (B) and, as necessary, a short fiber (C), and using this blended yarn and, as necessary, other yarns to produce a cloth or other fiber product.

(1-2) A method which comprises mixing a filament fiber (A), a filament fiber (B) and, as necessary, a filament fiber (C) to produce a mixed filament yarn containing a pyroelectric substance and a metal ion-holding inorganic particles, and using this mixed filament yarn and, as necessary an other yarn to produce a cloth or other fiber product.

(1-3) A method which comprises subjecting a fiber (A), a fiber (B) and, as necessary, a fiber (C) to any known entanglement or bonding such as entanglement by water jet, needling, bonding with binder, or the like to allow the fibers to be entangled or bonded with each other, to produce an unwoven cloth containing a pyroelectric substance and metal ion-holding inorganic particles.

Needless to say, the present invention is not restricted to the above methods.

In producing a fiber containing a pyroelectric substance and/or metal ion-holding inorganic particles, there is no restriction as to the method for adding a pyroelectric substance and/or metal ion-holding inorganic particles to a fiber-forming polymer. However, there can be employed the following methods, for example.

(a) A method of adding a pyroelectric substance and/or metal ion-holding inorganic particles during production of a fiber-forming polymer or right after the production.

(b) A method of adding a pyroelectric substance and/or metal ion-holding inorganic particles to a fiber-forming polymer produced, at a high concentration(s) to prepare a master batch.

(c) A method of adding a pyroelectric substance and/or metal ion-holding inorganic particles to a fiber-forming polymer in any stage up to spinning (e.g. a stage for producing polymer pellets or a spinning stage).

The method (a) includes, for example, a method of adding to a material slurry used for production of a fiber-forming polymer, a method of adding to a prepolymer right before its polycondensation, and a method of adding to a fiber-forming polymer which is right after production and is still in a liquid state.

In the fiber (A) containing only a pyroelectric substance, the content of the pyroelectric substance is preferably 0.1–20% by weight, more preferably 1–5% by weight based on the weight of the fiber-forming polymer. In the fiber (B) containing only metal ion-holding inorganic particles, the content of the metal ion-holding inorganic particles is preferably 0.1–20% by weight, more preferably 1–5% by weight based on the weight of the fiber-forming polymer. In the fiber (D) containing both a pyroelectric substance and metal ion-holding inorganic particles, the content of the pyroelectric substance and the content of the metal ion-holding inorganic particles are each preferably 0.1% by weight or more, more preferably 1% by weight or more, and their total content is preferably 20% by weight or less, more preferably 5% by weight or less.

When the content of the pyroelectric substance in the fiber (A) is less than 0.1% by weight or the content of the metal ion-holding inorganic particles in the fiber (B) is less than 0.1% by weight, the yarn, cloth or other fiber product produced using the fiber (A), the fiber (B) and, as necessary, the fiber (C) is unlikely to sufficiently exhibit the above-mentioned effects, that is, the activities of ameliorating diseases and promoting health (e.g. acceleration of blood circulation, cure of autonomic imbalance and promotion of metabolism), activities of maintaining the freshness of foods or natural flowers, the activity of removing oil stains, exhibiting microbicidal activity, etc. When the amount of the pyroelectric substance in the fiber (A) or the amount of the metal ion-holding inorganic particles in the fiber (B) is more than 20% by weight, troubles such as filter plugging, end breakage and the like occur easily during the spinning of the fiber (A) or the fiber (B) and the resulting fiber tends to have a reduced strength.

When the content of the pyroelectric substance and the content of the metal ion-holding inorganic particles in the fiber (D) are each less than 0.1% by weight, the yarn, cloth or other fiber product produced using the fiber (D) is unlikely to sufficiently exhibit the above-mentioned effects. When the total content of the pyroelectric substance and the metal ion-holding inorganic particles in the fiber (D) is more than 20% by weight, troubles such as filter plugging, end breakage and the like occur easily during the spinning of the fiber (D) and the resulting fiber (D) tends to have a reduced strength.

The contents or deposited amounts of the pyroelectric substance and the metal ion-holding inorganic particles can be varied depending upon the type and application, etc. of the fiber product produced. When the fiber product is, for example, a cloth, the contents or deposited amounts of the pyroelectric substance and the metal ion-holding inorganic particles are preferably each about 0.1–20% by weight based on the weight of the cloth because in these ranges the above-mentioned effects can be sufficiently exhibited. In the present fiber product, it is preferable that the metal ion-holding inorganic particles are present near the pyroelectric substance, because it allows for the effective amplification of the above-mentioned effects of the pyroelectric substance by the metal ion.

In producing the fiber product of the present invention by the above method (1) using a fiber (A), a fiber (B) and, as necessary, a fiber (C), the proportions of the fibers used can be varied depending upon, for example, the type and application of the fiber product produced, the content or deposited amount of the pyroelectric substance in the fiber (A), or the content or deposited amount of the metal ion-holding inorganic particles in the fiber (B). For examples when a fiber product is produced using a fiber (A) containing a pyroelectric substance in an amount of 0.1–20% by weight, a fiber (B) containing metal ion-holding inorganic particles in an amount of 0.1–20% by weight and, as necessary, a fiber (C), it is preferable to use the fiber (A), the fiber (B) and the fiber (C) at a weight ratio of 5–50:5–50:0–90.

The fiber constituting the fiber product of the present invention has no restriction as to the kind and may be any of a synthetic fiber, a semisynthetic fiber, a regenerated fiber, a natural fiber, an inorganic fiber, etc.

Examples of the synthetic fiber usable in the present invention include polyester fibers such as polyethylene terephthalate, polybutylene terephthalate and other polyesters; aliphatic polyamide fibers such as nylon 6, nylon 66, nylon 11, nylon 610, nylon 612 and the like; alicyclic polyamide fibers; aromatic polyamide fibers formed from an aromatic diamine and/or an aromatic dicarboxylic acid or a derivative thereof, such as polyphenyleneisophthalamide fiber, polyhexamethyleneterephthalamide fiber, p-phenyleneterephthalamide fiber and the like; polyolefin fibers such as polyethylene, polypropylene and the like; fibers composed of a vinyl chloride polymer such as polyvinyl chloride, vinyl chloride-vinyl acetate copolymer, vinyl chloride-acrylonitrile copolymer or the like; fibers composed of a vinylidene chloride polymer such as polyvinylidene chloride, vinylidene chloride-vinyl chloride copolymer, vinylidene chloride-vinyl acetate copolymer or the like; polyurethane fibers; acrylic fibers such as polyacrylonitrile, acrylonitrile-vinyl chloride copolymer and the like; polyvinyl alcohol type fibers; polychlal fibers; fluorine-containing polymer fibers; protein-acrylonitrile copolymer fibers; polyglycol fibers; and polyphenolic resin fibers.

Examples of the semisynthetic fiber usable in the present invention include acetate fibers, and examples of the regenerated fiber include rayon and cuprammonium rayon. Examples of the natural fiber usable in the present invention include cotton, hemp, wool and silk. In the present invention, there may also be used an inorganic fiber such as glass fiber, carbon fiber, metal fiber or the like.

Of the above fibers, a polyester fiber, a polyamide fiber, a polyurethane fiber, an acrylic fiber or a rayon is preferable for production of the present fiber product.

In the present invention, when a natural fiber is used as the fiber, it is preferable to deposit a pyroelectric substance and/or metal ion-holding inorganic particles on the natural fiber by the use of a binder (e.g. as an adhesive resin) because, as mentioned previously, it is difficult to allow the substance and the particles to be contained in the natural fiber. In this case, the deposition of the pyroelectric substance and the metal ion-holding inorganic particles on the natural fiber may be conducted before or after the production of a cloth or other fiber product using the natural fiber; however, the latter timing is convenient.

When the present fiber product is produced using a synthetic fiber, a semisynthetic fiber or a regenerated fiber, it is possible to use a fiber containing a pyroelectric substance and metal ion-holding inorganic particles, or a fiber having the substance and the particles deposited thereon; however, as mentioned previously, use of the former fiber is preferred.

The fiber constituting the fiber product of the present invention has no restriction as to the sectional shape or the structure. The sectional shape of the fiber may be various, for example, round, hollow, flat, oval, three to fourteen leaves-shaped, T-shaped, V-shaped, triangular to hexagonal or dog bone-shaped. The structure of the fiber may be, for example, a conjugated structure or a non-conjugated structure. When the fiber has a conjugated structure, it can be, for example, a core-sheath type conjugated fiber, a sea-island type conjugated fiber, a side-by-side type conjugated fiber, their mixture type conjugated fiber or a randomly conjugated fiber.

The fiber constituting the fiber product of the present invention has no restriction, either, as to the thickness. There is no restriction, either, as to the fiber shape in longitudinal direction. The fiber may have substantially a constant diameter or different diameters in the longitudinal direction, or may be other fiber. The fiber may be a short fiber, a long fiber or a filament fiber. When the fiber product of the present invention is a yarn, the yarn may be a spun yarn, a filament yarn or a short fiber-long fiber composite yarn, or may be subjected to a treatment such as false twisting, bulking, crimping or the like.

The fiber product of the present invention may be produced from one kind of fiber or two or more kinds of fibers each made from a different raw material. When the fiber consists of one kind of fiber, the fiber may be fixed in fineness, sectional shape or other properties, or may have variations in these properties. Specifically explaining, when the present fiber product is produced from the above-mentioned fibers (A), (B) and (C), the fibers (A), (B) and (C) may all be made from the same one raw material or may be two or more kinds of fibers each made from a different raw material.

The fiber constituting the present fiber product may contain, besides the pyroelectric substance and/or the metal ion-holding inorganic particles, various additives used customarily, such as an ultraviolet stabilizer, antioxidant, flame retardant, antistatic agent, coloring agent, lubricant, fungicide, insecticide, miticide, deodorant, ultraviolet absorber, matting agent, heat-storing agent and the like, depending upon the kind of fiber, etc.

The fiber product of the present invention includes various fiber products. Typical examples thereof are yarns; cloths such as woven cloth, knitted cloth, unwoven cloth and the like; pile cloths such as pile fabric, pile knit and the like; clothes and other wears made from the above yarns, cloths, pile cloths and the like; bedding; wrapping materials for foods; wrapping materials for natural flowers; and wiping articles. More specific typical examples of the present fiber product made from a fiber, a yarn, a cloth or the like each containing a pyroelectric substance and metal ion-holding inorganic particles are clothes and other wears such as underwear, socks, stockings, gloves, pajamas, coat, slacks, supporter, head band, cap, hat and the like; bedding such as wadding (e.g. cotton wool) for futon (a Japanese style bed consisting of a mattress and a bedquilt both stuffed thick with cotton wool), outside cloth for futon, sheet, blanket, cover for futon, pillow, cover for pillow, cover for bed, wadding for bed, and the like; and base sheet for cataplasma. When one uses the above clothes and/or other wears or sleeps in the above bedding, as compared with when using conventional fiber products containing only a pyroelectric substance, the effects such as acceleration of blood circulation, cure of autonomic imbalance, promotion of metabolism and the like appear more favorably, whereby diseases are ameliorated and health is promoted. Further, since the metal ion supported on the inorganic particles has an microbicidal activity by itself, the above clothes, other wears and bedding can be kept sanitarily. Furthermore, in washing the clothes, other wears and bedding, the oil stains, etc. adhering thereonto can be removed smoothly with a detergent amount smaller than used heretofore.

When the present fiber product containing a pyroelectric substance and metal ion-holding inorganic particles is used as a wrapping material for foods, it prevents or reduces the discoloration, deterioration, putrefaction, etc. of food and can maintain the freshness of food well for a long time. The form of the wrapping material is not particularly restricted and may be, for example, a unwoven cloth or a thick fiber structure having also a cushion effect. There is no particular restriction as to the kind of food to which the wrapping material of the present invention is applicable; however, the present wrapping material is suitable for wrapping of perishable foods such as meats, fish, vegetables, fruits, egg and the like and also for wrapping of various foods of high water content which allow for no long-term storage.

When the present fiber product is used as a wrapping material for natural flowers, it reduces the discoloration, drooping, etc. of natural flowers and can keep the colors and conditions of flower and leaves well for a long time. For example, wrapping of natural flowers prior to shipping can keep the quality of the flowers well for a long time, whereby natural flowers of high commercial value can be provided to consumers. There is no particular restriction as to the kind of natural flowers to which the present wrapping material is applicable, and the present wrapping material can be used for wrapping of various natural flowers such as orchids, roses, lilies, tulips, Transvaal daisies, carnations and the like.

The present fiber product containing a pyroelectric substance and metal ion-holding inorganic particles, when used as a wrapping material for foods or natural flowers, can take various forms fitting the size and/or shape of food or flower to be wrapped. For example, the forms can be a sheet for wrapping foods or natural flowers, a band for making a bundle of foods or natural flowers, a bag for accommodating foods or natural flowers, and flocks used as a filler when foods or natural flowers are wrapped with other wrapping material.

The wiping article produced from the present fiber product containing a pyroelectric substance and metal ion-holding inorganic particles, is very effective, for example, as a wiping cloth used for washing tableware, etc. or as a cloth used for washing one's body. The wiping article can smoothly remove the oil stains adhering onto tableware and the oil and fat or stains on the human body and make them clean, without using any soap or detergent or with a soap or detergent of an amount smaller than used heretofore. There is no restriction as to the size and shape of the wiping cloth or the cloth used for washing none' body, and the size and shape can be determined depending upon the application purpose of the cloth. However, the wiping article can take, for example, an ordinary square cloth form, a mitten form into which one's hand can be put, and a towel form with which one's back, etc. can be washed.

The present invention is hereinafter described more specifically by way of Examples and Comparative Examples. However, the present invention is not restricted thereby.

EXAMPLE 1

(1) To a polyethylene terephthalate (intrinsic viscosity=0.75) was added 5% by weight, based on the weight of the former, of a fine powder (average particle diameter=1 $\mu$m or less) of tourmaline (origin: Brazil). The mixture was spun from a spinning nozzle at a temperature of 280° C. The resulting filament was subjected to stretching and crimping by an ordinary method and then was cut to produce a short fiber [fiber (A)] having a fineness of 3 deniers and a fiber length of 51 mm.

(2) To a polyethylene terephthalate (intrinsic viscosity=0.75) was added 2% by weight, based on the weight of the former, of a fine powder of zeolite subjected to ion exchange with silver ion and zinc ion (ZEOMIC, a product of Shinagawa Fuel Co., Ltd.). The mixture was spun from a spinning nozzle at a temperature of 280° C. The resulting filament was subjected to stretching and crimping by an ordinary method and then was cut to produce a short fiber [fiber (B)] having a fineness of 3 deniers and a fiber length of 51 mm.

(3) The procedure of the above (1) was repeated except that no tourmaline fine powder was added, whereby a short fiber [fiber (C)] having a fineness of 3 deniers and a fiber length of 51 mm was produced.

(4) The fibers (A), (B) and (C) obtained in the above (1), (2) and (3), respectively, were mixed at a weight ratio of 30:40:30. The mixture was subjected to ordinary spinning to produce a spun yarn of 20 yarn number (cotton yarn number). Using this spun yarn as a pile yarn and, as a ground yarn, a spun yarn of 20 yarn number, consisting of 100% polyethylene terephthalate, a seal blanket (pile length=about 10 mm, weight per unit area=about 1,000 g/m$^2$) was produced using a loom for seal woven fabric.

COMPARATIVE EXAMPLE 1

The procedure of (4) of Example 1 was repeated except that the pile yarn used in Example 1 was changed to a spun yarn of 20 yarn number obtained by mixing the fiber (A) obtained in (1) of Example 1 and the fiber (C) obtained in (3) of Example 1, at a weight ratio of 30:70, whereby a seal blanket (pile length=about 10 mm, weight per unit area=about 1,000 g/m$^2$) was produced.

COMPARATIVE EXAMPLE 2

The procedure of (4) of Example 1 was repeated except that the pile yarn used in Example 1 was changed to a spun yarn of 20 yarn number obtained by mixing the fiber (B) obtained in (2) of Example 1 and the fiber (C) obtained in (3) of Example 1, at a weight ratio of 30:70, whereby a seal blanket (pile length=about 10 mm, weight per unit area=about 1,000 g/m$^2$) was produced.

COMPARATIVE EXAMPLE 3

The procedure of (4) of Example 1 was repeated except that the pile yarn used in Example 1 was changed to a spun yarn of 20 yarn number produced only from the fiber (C) obtained in (3) of Example 1, whereby a seal blanket (pile length=about 10 mm, weight per unit area=about 1,000 g/m$^2$) was produced.

CLINICAL TEST

Each of six patients A to F who had been in hospital due to interruption in peripheral blood circulation (e.g. cerebral infarction), was allowed to use the seal blankets produced in Example 1 and Comparative Examples 1, 2 and 3, in this order continuously (one week for each blanket, total four weeks). During this period, the sole temperatures of each patient were measured daily using a body temperature tester (THERMOVISION, a product of Japan Electron Optics Laboratory Co., Ltd.), and the average body temperature of one week was calculated for each blanket and each patient. The results are shown in Table 1.

TABLE 1

| | Example 1 Temperature (° C.) of: | | Comparative Example 1 Temperature (° C.) of: | | Comparative Example 2 Temperature (° C.) of: | | Comparative Example 3 Temperature (° C.) of: | | |
|---|---|---|---|---|---|---|---|---|---|
| Patient | Right sole | Left sole | Right sole | Left sole | Right sole | Left sole | Right sole | Left sole | Effect[1] |
| A | 32.3 | 32.7 | 28.6 | 30.1 | 27.7 | 28.3 | 26.7 | 26.5 | High |
| B | 27.2 | 28.8 | 26.4 | 26.2 | 28.1 | 27.8 | 29.8 | 29.3 | No |
| C | 30.9 | 31.6 | 29.1 | 29.3 | 27.6 | 27.9 | 26.0 | 26.5 | High |
| D | 29.8 | 31.7 | 25.7 | 25.8 | 26.7 | 26.8 | 27.7 | 27.8 | High |
| E | 29.4 | 27.7 | 27.8 | 27.6 | 26.6 | 26.7 | 25.3 | 25.7 | High |
| F | 28.6 | 27.7 | 27.8 | 27.6 | 26.6 | 26.7 | 25.3 | 25.8 | Seen |

[1]Temperature increase of blanket of Example 1 over blankets of Comparative Examples 1–3.

As is clear from Table 1, five of the six patients gave higher temperatures at the soles (terminal points of the human body) when used the seal blanket of Example 1 containing both a pyroelectric substance and metal ion-holding inorganic particles, as compared with each case of when used the seal blanket of Comparative Example 1 containing only a pyroelectric substance, when used the seal blanket of Comparative Example 2 containing only metal ion-holding inorganic particles and when used the seal blanket of Comparative Example 3 containing neither pyroelectric substance nor metal ion-holding inorganic particles. This increase in body temperature indicates that the seal blanket of the present invention has an excellent effect in acceleration of blood circulation.

EXAMPLE 2

(1) To a rayon material was added 5% by weight, based on the weight of the former, of a fine powder (average particle diameter=1 μm or less) of tourmaline (origin: Brazil). The mixture was spun according to an ordinary method. The resulting filament was cut to produce a rayon short fiber [fiber (A)] having a fineness of 2 deniers and a fiber length of 51 mm.

(2) To a polyethylene terephthalate (intrinsic viscosity=0.75) was added 2% by weight, based on the weight of the former, of a fine powder of zeolite subjected to ion exchange with silver ion and zinc ion (ZEOMIC, a product of Shinagawa Fuel Co., Ltd.). The mixture was spun from a spinning nozzle of 280° C. The resulting filament was subjected to stretching and crimping by an ordinary method and then was cut to produce a polyester short fiber [fiber (B)] having a fineness of 1.4 deniers and a fiber length of 51 mm.

(3) The procedure of the above (1) was repeated except that no tourmaline fine powder was added, whereby a rayon short fiber [fiber (C)] having a fineness of 2 deniers and a fiber length of 51 mm was produced.

(4) The fibers (A), (B) and (C) obtained in the above (1), (2) and (3), respectively, were mixed at a weight ratio of 5:30:65. The mixture was subjected to ordinary opening-carding and then to entanglement by water jet to produce an unwoven cloth (weight per unit area=25 g/cm$^2$). This unwoven cloth was cut into a size of 30 cm×50 cm to produce a wrapping material for foods.

EXAMPLE 3

(1) To a polyethylene terephthalate (intrinsic viscosity=0.75) were added 2% by weight, based on the weight of the former, of a fine powder of tourmaline (origin: Brazil) having an average particle diameter of 1 μm or less and 10% by weight, based on the weight of the former, of a fine powder of zeolite subjected to ion exchange with silver ion and zinc ion (ZEOMIC, a product of Shinagawa Fuel Co., Ltd.). The mixture was made into a fiber under the same conditions as in (2) of Example 2 to produce a polyester short fiber [fiber (A')] having a fineness of 1.4 deniers and a fiber length of 51 mm.

(2) The fiber (A') obtained in the above (1) and the fiber (C) obtained in (3) of Example 2 were mixed at a weight ratio of 85:15. The mixture was subjected to ordinary opening-carding and then to entanglement by water jet to produce an unwoven cloth (weight per unit area=28 g/cm$^2$). This unwoven cloth was cut into a size of 30 cm×50 cm to produce a wrapping material for foods.

EXAMPLE 4

(1) To a polyethylene terephthalate (intrinsic viscosity=0.75) were added 10% by weight, based on the weight of the former, of a fine powder of tourmaline (origin: Brazil) having an average particle diameter of 1 μm or less and 2% by weight, based on the weight of the former, of a fine powder of zeolite subjected to ion exchange with silver ion and zinc ion (ZEOMIC, a product of Shinagawa Fuel Co., Ltd.). The mixture was made into a fiber under the same conditions as in (2) of Example 2 to produce a polyester short fiber [fiber (A")] having a fineness of 1.4 deniers and a fiber length of 51 mm.

(2) The fiber (A") obtained in the above (1) and the fiber (C) obtained in (3) of Example 2 were mixed at a weight ratio of 10:90. The mixture was subjected to ordinary opening-carding and then to entanglement by water jet to produce an unwoven cloth (weight per unit area=26 g/cm$^2$). This unwoven cloth was cut into a size of 30 cm×50 cm to produce a wrapping material for foods.

COMPARATIVE EXAMPLE 4

The procedure of (4) of Example 2 was repeated except that the mixture was changed to one obtained by mixing, at a weight ratio of 10:90, the fiber (A) (a rayon short fiber containing tourmaline) produced in (1) of Example 2 and the fiber (C) (a rayon short fiber containing neither tourmaline nor metal ion-holding inorganic particles) produced in (3) of Example 2, whereby a wrapping material for foods, made of an unwoven cloth was produced.

COMPARATIVE EXAMPLE 5

The procedure of (4) of Example 2 was repeated except that the mixture was changed to one obtained by mixing, at a weight ratio of 10:90, the fiber (B) (a polyethylene terephthalate short fiber containing metal ion-holding inorganic particles) produced in (2) of Example 2 and the fiber (C) (a rayon short fiber containing neither tourmaline nor metal ion-holding inorganic particles) produced in (3) of Example 2, whereby a wrapping material for foods, made of an unwoven cloth was produced.

COMPARATIVE EXAMPLE 6

Using the same procedure as in (4) of Example 2 except that only the fiber (C) (a rayon short fiber containing neither tourmaline nor metal ion-holding inorganic particles) produced in (3) of Example 2 was used, a wrapping material for foods, made of an unwoven cloth was produced.

Broccoli (about 100 g) was wrapped using each of the wrapping materials for foods, produced in Examples 2, 3 and 4 and Comparative Examples 4, 5 and 6, and stored in a refrigerator of 5° C. After the storage of 3 days, 7 days or 10 days, the conditions of broccoli was observed with naked eyes. The results are shown in Table 2.

Separately, beef (about 100 g) was wrapped using each of the above wrapping materials and stored in a refrigerator of 5° C. After the storage of 3 days, 7 days or 14 days, the conditions of beef was observed with naked eyes. The results are shown in Table 2.

TABLE 2

| | Storage period | Example 2 | Example 3 | Example 4 |
|---|---|---|---|---|
| Broccoli | 3 Days | No change | No change | No change |
| | 7 Days | No change | No change | No change |
| | 10 Days | The green portion became slightly yellowish. | No change | The green portion became slightly yellowish. |
| Beef | 3 Days | No change | No change | No change |
| | 7 Days | The lean meat at the surface became slightly blackish. | No change | The lean meat at the surface became slightly blackish. |
| | 14 Days | The meat surface seemed to have increased blackness slightly. | The lean meat at the surface became slightly blackish. | The mean surface seemed to have increased blackness slightly. |
| | Storage period | Comparative Example 4 | Comparative Example 5 | Comparative Example 6 |
| Broccoli | 3 Days | The green portion became slightly yellowish. | The green portion became slightly yellowish. | Became slightly yellowish. |
| | 7 Days | Turned yellowish and the stem became slightly jellylike. | Same as left | Same as left |
| | 10 Days | Gave putrid smell. | Same as left | Same as left |
| Beef | 3 Days | The lean meat at the surface became blackish. | The lean meat at the surface became blackish. | The lean meat at the surface became blackish. |
| | 7 Days | The meat became black and hard. The section showed discoloration to the center. | Same as left | Same as left |
| | 14 Days | Gave putrid smell. | Same as left | Same as left |

As is clear from Table 2, when broccoli was wrapped using each of the wrapping materials of Examples 2, 3 and 4 containing both a pyroelectric substance and metal ion-holding inorganic particles, none of the broccolis showed yellowing or putrefaction even after 7 days and kept good freshness; some of the broccolis showed slight yellowing after 10 days; thus, the freshness of broccoli was kept well for a long time. In contrast, when using the wrapping material of Comparative Example 4 containing only a pyroelectric substance, when using the wrapping material of Comparative Example 5 containing only metal ion-holding inorganic particles, and when using the wrapping material of Comparative Example 6 containing neither pyroelectric substance nor metal ion-holding inorganic particles, all the broccolis began to putrefy after 7 days; gave a putrid smell after 10 days; thus, did not keep good freshness for a long time.

As is also clear from Table 2, when beef was wrapped using each of the wrapping materials of Examples 2, 3 and 4 containing both a pyroelectric substance and metal ion-holding inorganic particles, none of the beefs showed any change at least after 3 days and maintained good freshness; all the beefs showed slight discoloration after 7 days; thus, all the beefs showed good freshness for a long time. In contrast, when using the wrapping material of Comparative Example 4 containing only a pyroelectric substance, when using the wrapping material of Comparative Example 5 containing only metal ion-holding inorganic particles, and when using the wrapping material of Comparative Example 6 containing neither pyroelectric substance nor metal ion-holding inorganic particles, all the beefs turned blackish at the lean meat portion after 3 days; showed discoloration and meat hardening after 7 days; gave a putrid smell after 14 days; thus, did not keep good freshness for a long time.

EXAMPLE 5

(1) To a rayon material was added 5% by weight, based on the weight of the former, of a fine powder (average particle diameter=1 μm or less) of tourmaline (origin: Brazil). The mixture was spun according to an ordinary method. The resulting filament was cut to produce a rayon short fiber [fiber (A)] having a fineness of 2 deniers and a fiber length of 51 mm.

(2) To a polyethylene terephthalate (intrinsic viscosity=0.75) was added 2% by weight, based on the weight of the former, of a fine powder of zeolite subjected to ion exchange with silver ion and zinc ion (ZEOMIC, a product of Shinagawa Fuel Co., Ltd.). The mixture was spun from a spinning nozzle of 280° C. The resulting filament was subjected to stretching and crimping by an ordinary method and then was cut to produce a polyester short fiber [fiber (B)] having a fineness of 1.4 deniers and a fiber length of 38 mm.

(3) The procedure of the above (1) was repeated except that no tourmaline fine powder was added, whereby a rayon short fiber [fiber (C)] having a fineness of 2 deniers and a fiber length of 51 mm was produced.

(4) The fibers (A), (B) and (C) obtained in the above (1), (2) and (3), respectively, were mixed at a weight ratio of 30:20:50. The mixture was subjected to ordinary opening-carding and then to entanglement by water jet to produce an unwoven cloth (weight per unit area=40 g/cm$^2$). This unwoven cloth was cut into a size of 30 cm×30 cm to produce a wiping cloth.

EXAMPLE 6

(1) To a rayon material was added 2% by weight, based on the weight of the former, of a fine powder (average particle diameter=1 μm or less) of tourmaline (origin: Brazil). The mixture was spun according to an ordinary method. The resulting filament was cut to produce a rayon short fiber [fiber (A')] having a fineness of 2 deniers and a fiber length of 51 mm.

(2) To a polyethylene terephthalate (intrinsic viscosity=0.75) was added 18% by weight, based on the weight of the former, of a fine powder of zeolite subjected to ion exchange with silver ion and zinc ion (ZEOMIC, a product of Shinagawa Fuel Co., Ltd.). The mixture was spun from a spinning nozzle of 280° C. The resulting filament was subjected to stretching and crimping by an ordinary method and then was cut to produce a polyester short fiber [fiber (B')] having a fineness of 1.4 deniers and a fiber length of 38 mm.

(3) The fibers (A'), (B') and the fiber (C) obtained in (3) of Example 5 were mixed at a weight ratio of 45:10:45. The mixture was subjected to ordinary opening-carding and then to entanglement by water jet to produce an unwoven cloth (weight per unit area=40 g/cm$^2$). This unwoven cloth was cut into a size of 30 cm×30 cm to produce a wiping cloth.

EXAMPLE 7

(1) To a rayon material was added 18% by weight, based on the weight of the former, of a fine powder (average particle diameter=1 μm or less) of tourmaline (origin: Brazil). The mixture was spun according to an ordinary method. The resulting filament was cut to produce a rayon short fiber [fiber (A")] having a fineness of 2 deniers and a fiber length of 51 mm.

(2) To a polyethylene terephthalate (intrinsic viscosity=0.75) was added 2% by weight, based on the weight of the former, of a fine powder of zeolite subjected to ion exchange with silver ion and zinc ion (ZEOMIC, a product of Shinagawa Fuel Co., Ltd.). The mixture was spun from a spinning nozzle of 280° C. The resulting filament was subjected to stretching and crimping by an ordinary method and then was cut to produce a polyester short fiber [fiber (B")] having a fineness of 1.4 deniers and a fiber length of 38 mm.

(3) The fibers (A"), (B") and the fiber (C) obtained in (3) of Example 5 were mixed at a weight ratio of 8:12:80. The mixture was subjected to ordinary opening-carding and then to entanglement by water jet to produce an unwoven cloth (weight per unit area=40 g/cm$^2$). This unwoven cloth was cut into a size of 30 cm×30 cm to produce a wiping cloth.

EXAMPLE 8

(1) To a polyethylene terephthalate (intrinsic viscosity=0.75) were added 0.3% by weight, based on the weight of the former, of a fine powder of tourmaline (origin: Brazil) having an average particle diameter of 1 μm or less and 0.3% by weight, based on the weight of the former, of a fine powder of zeolite subjected to ion exchange with silver ion and zinc ion (ZEOMIC, a product of Shinagawa Fuel Co., Ltd.). The mixture was made into a fiber under the same conditions as in (2) of Example 2 to produce a polyester short fiber [fiber (A''')] having a fineness of 1.4 deniers and a fiber length of 51 mm.

(2) The fiber (A''') obtained in the above (1) and the fiber (C) obtained in (3) of Example 5 were mixed at a weight ratio of 60:40. The mixture was subjected to ordinary opening-carding and then to entanglement by water jet to produce an unwoven cloth (weight per unit area=40 g/cm$^2$). This unwoven cloth was cut into a size of 30 cm×30 cm to produce a wiping cloth.

COMPARATIVE EXAMPLE 7

The procedure of (4) of Example 5 was repeated except that the mixture was changed to one obtained by mixing, at a weight ratio of 30:70, the fiber (A) (a rayon short fiber containing tourmaline) produced in (1) of Example 5 and the fiber (C) (a rayon short fiber containing neither tourmaline nor metal ion-holding inorganic particles) produced in (3) of Example 5, whereby a wiping cloth made of an unwoven cloth was produced.

COMPARATIVE EXAMPLE 8

The procedure of (4) of Example 5 was repeated except that the mixture was changed to one obtained by mixing, at a weight ratio of 30:70, the fiber (B) (a polyester short fiber containing metal ion-holding inorganic particles) produced in (2) of Example 5 and the fiber (C) (a rayon short fiber containing neither tourmaline nor metal ion-holding inorganic particles) produced in (3) of Example 5, whereby a wiping cloth made of an unwoven cloth was produced.

COMPARATIVE EXAMPLE 9

Using the same procedure as in (4) of Example 5 except that only the fiber (C) (a rayon short fiber containing neither tourmaline nor metal ion-holding inorganic particles) produced in (3) of Example 5 was used, a wiping cloth made of an unwoven cloth was produced.

Ten glass dishes (diameter=about 7 cm, depth=5 cm) were prepared. The inner surfaces of these dishes were uniformly coated with a salad oil, using an absorbent cotton impregnated with the salad oil. Then, the coated dishes were washed, each for 20 seconds, using one of the wiping cloths produced in Examples 5–8 and Comparative Examples 7–9, without using any detergent while tap water of about 25° C. was allowed to keep flowing. Thereafter, the degree of removal of salad oil coated on inner surface of dish was observed with naked eyes and also examined by hand touch. The results are shown in Table 3.

TABLE 3

| | Results of dish washing |
|---|---|
| Example 5 | The oil was completely removed in all of the ten dishes. |
| Example 6 | The oil was completely removed in all of the ten dishes. |
| Example 7 | The oil was completely removed in all of the ten dishes. |
| Example 8 | The oil was completely removed in all of the ten dishes. |
| Comparative Example 7 | The oil was removed in most of the dishes but remained partly in two dishes. |

TABLE 3-continued

| | Results of dish washing |
|---|---|
| Comparative Example 8 | The oil was not removed completely and remained partly, in all of the ten dishes. |
| Comparative Example 9 | The oil was not removed completely and remained partly, in all of the ten dishes. |

As is clear from Table 3, when the oil-coated dishes were washed using each of the wiping cloths of Examples 5–8 containing both a pyroelectric substance and metal ion-holding inorganic particles, although no detergent was used, oil stain of dish could be removed effectively with normal-temperature water, making it possible to prevent the contamination of waste water with detergent, etc. In contrast, when using the wiping cloth of Comparative Example 7 containing only a pyroelectric substance, when using the wiping cloth of Comparative Example 8 containing only metal ion-holding inorganic particles, and when using the wiping cloth of Comparative Example 9 containing neither pyroelectric substance nor metal ion-holding inorganic particles, oil stain of dish could not be removed completely with normal-temperature water alone, making it necessary to use a detergent or hot water.

Next, three plastic dishes (diameter=about 7 cm, depth=5 cm) were prepared. The inner surfaces of these dishes were uniformly coated with lard, using an absorbent cotton impregnated with the lard and then were wiped with one of the wiping cloths produced in Examples 5–8 and Comparative Examples 7–9. The degree of lard remaining on inner surface of dish after wiping was examined by the following test method No. 343 of 1978 (Oil Red method) appearing in the bulletin of school meals.

Oil Red method: An appropriate amount of 0.1% Oil Red ethanol solution is placed in a dish. The dish is rotated so that the Oil Red solution is spread throughout the inner surface of the dish. Then, the dish is lightly washed in a water bath filled with water while tap water is allowed to hit the dish. In this case, the dish portion at which a fatty substance remains, gives a red color. When the dish has an inside portion(s) of red color, the dish is rated as positive (+); when the dish has no red color portion inside, the dish is rated as negative (−).

The results are shown in Table 4.

TABLE 4

| | Dish 1 | Dish 2 | Dish 3 |
|---|---|---|---|
| Example 5 | − | − | − |
| Example 6 | − | − | − |
| Example 7 | − | − | − |
| Example 8 | − | − | − |
| Comparative Example 7 | + | + | − |
| Comparative Example 8 | + | − | + |
| Comparative Example 9 | + | + | + |

As is clear from Table 4, no lard remained on any dish when the lard-adhering dishes were wiped using each of the wiping cloths of Examples 5–8 containing both a pyroelectric substance and metal ion-holding inorganic particles. In contrast, lard remained on at least two of the three dishes when using the wiping cloth of Comparative Example 7 containing only a pyroelectric substance, when using the wiping cloth of Comparative Example 8 containing only metal ion-holding inorganic particles, and when using the wiping cloth of Comparative Example 9 containing neither pyroelectric substance nor metal ion-holding inorganic particles.

In summary, the fiber product of the present invention, wherein the pyroelectric property of the pyroelectric substance contained therein is amplified by the metal ion-holding inorganic particles also contained therein, exhibits, with no necessity of using a large amount of a pyroelectric substance which is expensive, effects of ameliorating diseases and promoting health, such as acceleration of blood circulation, cure of autonomic imbalance, promotion of metabolism and the like. The present fiber product further has an activity of keeping the freshness of foods or natural flowers, an activity of removing oil stains and a microbicidal activity.

When used as clothes, other wears or bedding, the present fiber product, particularly, the pyroelectric substance contained therein stimulates pressure points of human body, whereby acceleration of blood circulation, promotion of metabolism, cure of autonomic imbalance, etc. are exhibited more effectively than heretofore, leading to amelioration of diseases and promotion of health. Further, since the metal ion supported on the inorganic particles has a microbicidal activity by itself, the clothes, other wears and bedding used can be kept sanitarily. Furthermore, when the clothes, other wears and bedding used are washed, the oil stains, etc. adhering thereonto can be smoothly removed at a detergent amount smaller than used heretofore.

When used as a wrapping material for foods, the present fiber product can prevent the discoloration and deterioration of foods, whereby their freshness can be kept for a long time. When used as a wrapping material for natural flowers, the present fiber product can reduce the discoloration and drooping of natural flowers, whereby they can be utilized longer.

When used as a cloth for washing tableware or human body, the present fiber product can smoothly remove the oil stains adhering onto the tableware or the fatty substance on human body without using any detergent or soap or using a detergent or soap of an amount smaller than used heretofore.

What is claimed is:

1. A fiber product produced using (1) 5 to 45 parts by weight of an organic fiber containing tourmaline or having tourmaline deposited thereon, said tourmaline being present in an amount of 0.3 to 18% by weight based upon the weight of the organic fiber, (2) 10 to 40 parts by weight of an organic fiber containing metal ion-holding inorganic particles or having said inorganic particles deposited thereon, said inorganic particles being present in an amount of 0.3 to 18% by weight based upon the weight of the organic fiber, and (3) 30 to 80 parts by weight of an organic fiber containing neither tourmaline nor metal ion-holding inorganic particles, nor having either tourmaline or metal ion-holding inorganic particles deposited thereon, wherein the total amount of said organic fibers (1), (2) and (3) is 100 parts by weight and each of said organic fibers (1), (2) and (3) is at least one of a synthetic fiber, a semisynthetic fiber, a regenerated fiber and a natural fiber.

2. A fiber product according to claim 1, wherein the tourmaline in (1) is present in an amount of 2 to 18% by weight, based on the weight of the organic fiber, the metal ion-holding inorganic particles in (2) are present in an amount of 2 to 10% by weight, based on the weight of the organic fiber, and the organic fiber in (3) is present in an amount of 45 to 80 parts by weight of said organic fiber.

3. A fiber product according to claim 1, in which the tourmaline is present in an amount of at least 5% by weight and the metal ion-holding inorganic particles are present in an amount of at least 2% by weight, based on the weight of said organic fibers.

4. A fiber product produced using (1) 10 to 85 parts by weight of an organic fiber containing tourmaline and metal ion-holding inorganic particles or having tourmaline and said inorganic particles deposited thereon, said tourmaline being present in an amount of 0.3 to 18% by weight and said inorganic particles being present in an amount of 0.3 to 18% by weight, both based upon the weight of the organic fiber, and (2) 15 to 90 parts by weight of an organic fiber containing neither tourmaline nor metal ion-holding inorganic particles, nor having either tourmaline or metal ion-holding inorganic particles deposited thereon, wherein the total amount of said organic fibers (1) and (2) is 100 parts by weight and each of said organic fibers (1) and (2) is at least one of a synthetic fiber, a semisynthetic fiber, a regenerated fiber and a natural fiber.

5. A fiber product according to claim 4, in which the tourmaline in (1) is present in an amount of 0.4 to 18% by weight and wherein said metal ion-holding inorganic particles are present in an amount of 0.4 to 10% by weight, based upon the weight of the organic fiber.

6. A fiber product according to claim 4, in which the tourmaline is present in an amount of at least 5% by weight and the metal ion-holding inorganic particles are present in an amount of at least 2% by weight, based on the weight of said organic fibers.

7. A fiber product according to claim 1 or 4 in the form of a cloth.

8. A fiber product according to claim 1 or 4 in the form of clothes.

9. A fiber product according to claim 1 or 4 wherein the tourmaline and metal ion holding inorganic particles are in the form of fine powders uniformly dispersed within the organic fiber.

10. A fiber product according to claim 1 or 4 wherein tourmaline and metal ion holding inorganic particles are in the form of fine powders deposited on the surface of the organic fiber.

* * * * *